United States Patent [19]

Paley

[11] Patent Number: 4,896,766

[45] Date of Patent: Jan. 30, 1990

[54] DISPLAY CARTON

[75] Inventor: Sandra D. Paley, Mayfield Heights, Ohio

[73] Assignee: Container Corporation of America, Clayton, Mo.

[21] Appl. No.: 348,393

[22] Filed: May 8, 1989

[51] Int. Cl.[4] ..... B65D 5/50
[52] U.S. Cl. ..... 206/45.15; 206/327
[58] Field of Search ..... 206/45.13, 45.14, 45.15, 206/327

[56] References Cited

U.S. PATENT DOCUMENTS

| | | | |
|---|---|---|---|
| 1,726,732 | 9/1929 | Doran | 206/45.15 X |
| 2,616,558 | 11/1952 | Kay, Jr. | 206/45.15 X |
| 3,823,864 | 7/1974 | Ohkubo | 206/45.14 X |
| 3,900,100 | 8/1975 | Girman | 206/45.15 X |

*Primary Examiner*—William Price
*Attorney, Agent, or Firm*—Richard W. Carpenter

[57] ABSTRACT

A display carton formed from a unitary sheet of paperboard, and having a body with hollow front and side walls which define, with the rear and bottom walls, a well, and a hinged cover that includes an attached article holding member that automatically pops up when the cover is opened to display the packaged article dramatically.

16 Claims, 3 Drawing Sheets

DISPLAY CARTON

BACKGROUND OF THE INVENTION

1. Field of the Invention

This invention relates to display cartons, and more particularly to a display carton including a body and an integral hinged cover having a holding and displaying member attached thereto, so that when the cover is opened, the displayed article will be automatically raised to display the article dramatically.

2. Description of the Background Art

A background art search directed to the subject matter of this application conducted in the U.S. Patent and Trademark Office disclosed the following United States and foreign Letters Patent:

| | | | |
|---|---|---|---|
| 2,442,980 | 2,616,558 | 2,670,126 | 2,755,982 |
| 2,951,583 | 3,084,790 | 3,159,273 | 3,900,100 |
| Sweden 138,552 | | | |

None of the patents uncovered in the background art search discloses a display carton having hollow front and side walls which define with the bottom and rear walls a well for receiving a packaged article positioned within an article holding member hingedly attached to the cover in such a manner that the article will pop up and move rearwardly when the cover is opened.

SUMMARY OF THE INVENTION

It is an object of the present invention to provide a display package that includes an inner carton with a hinged cover, for holding and displaying an article, and an outer sleeve for enclosing the inner carton.

A more specific object of the invention is the provision of a display package that includes an inner carton with a pop-up feature wherein the displayed article is moved upwardly as the carton cover is opened.

Another more specific object of the invention is the provision, in a display carton of the type described, of a structure having hollow front and side walls which form with the rear and bottom walls of the carton a well adapted to receive a packaged article held in a holding member attached to the cover of the carton in such a manner that the article will pop up when the cover is opened.

These and other objects of the invention will be apparent from an examination of the following description and drawings.

It will be understood that, for purposes of clarity, certain elements may have been intentionally omitted from certain views where thy are believed to be illustrated to better advantage in other views.

DESCRIPTION OF THE PREFERRED EMBODIMENT

The purpose of the invention is to provide an attractive display package for holding a relatively small product, such as a cosmetic or automotive item, and displaying it in a unique manner whereby the product pops up when the package is opened. The package may consist of a single carton, or it may comprise a combination of an inner carton disposed within an outer sleeve.

Figure 2:
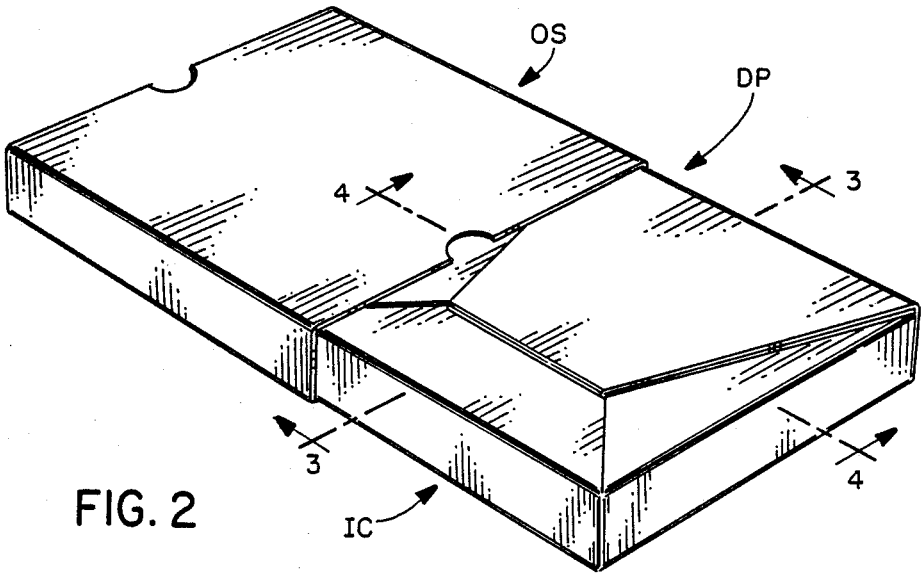
FIG. 2 is an isometric view of a display package embodying features of the invention, with the carton shown inserted part way into an outer sleeve.
Figure 3:
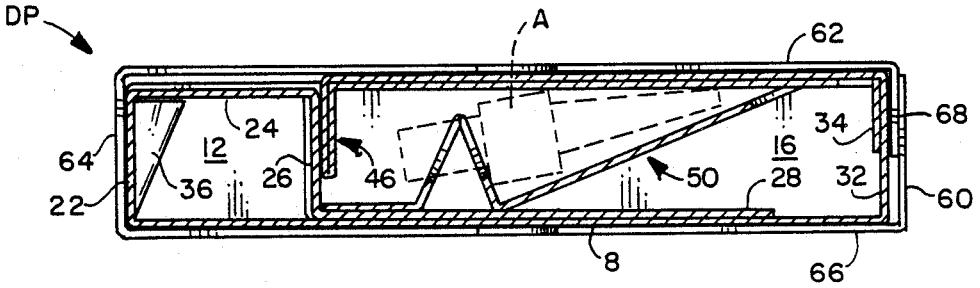
FIGS. 3 and 4 are fragmentary vertical sectional views taken on lines 3—3 and 4—4, respectively, of FIG. 2.
Figure 4:
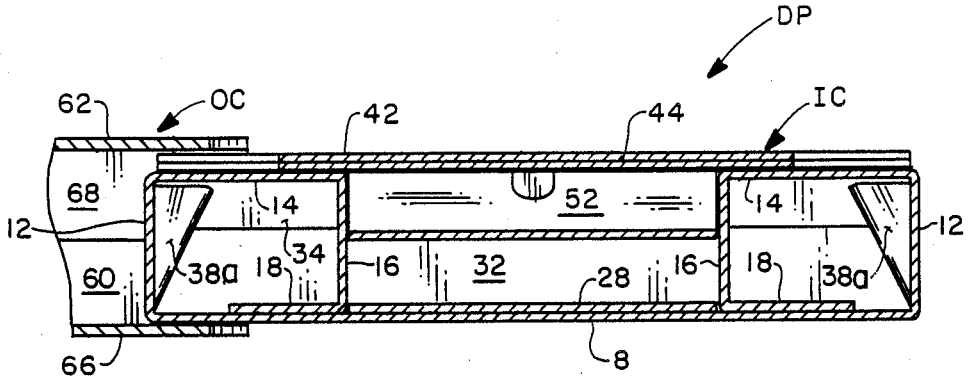

In the present application, as best seen in FIGS. 2–4, the novel display package DP, includes an inner carton IC which is received within an outer sleeve OS.

Figures 7, 8:
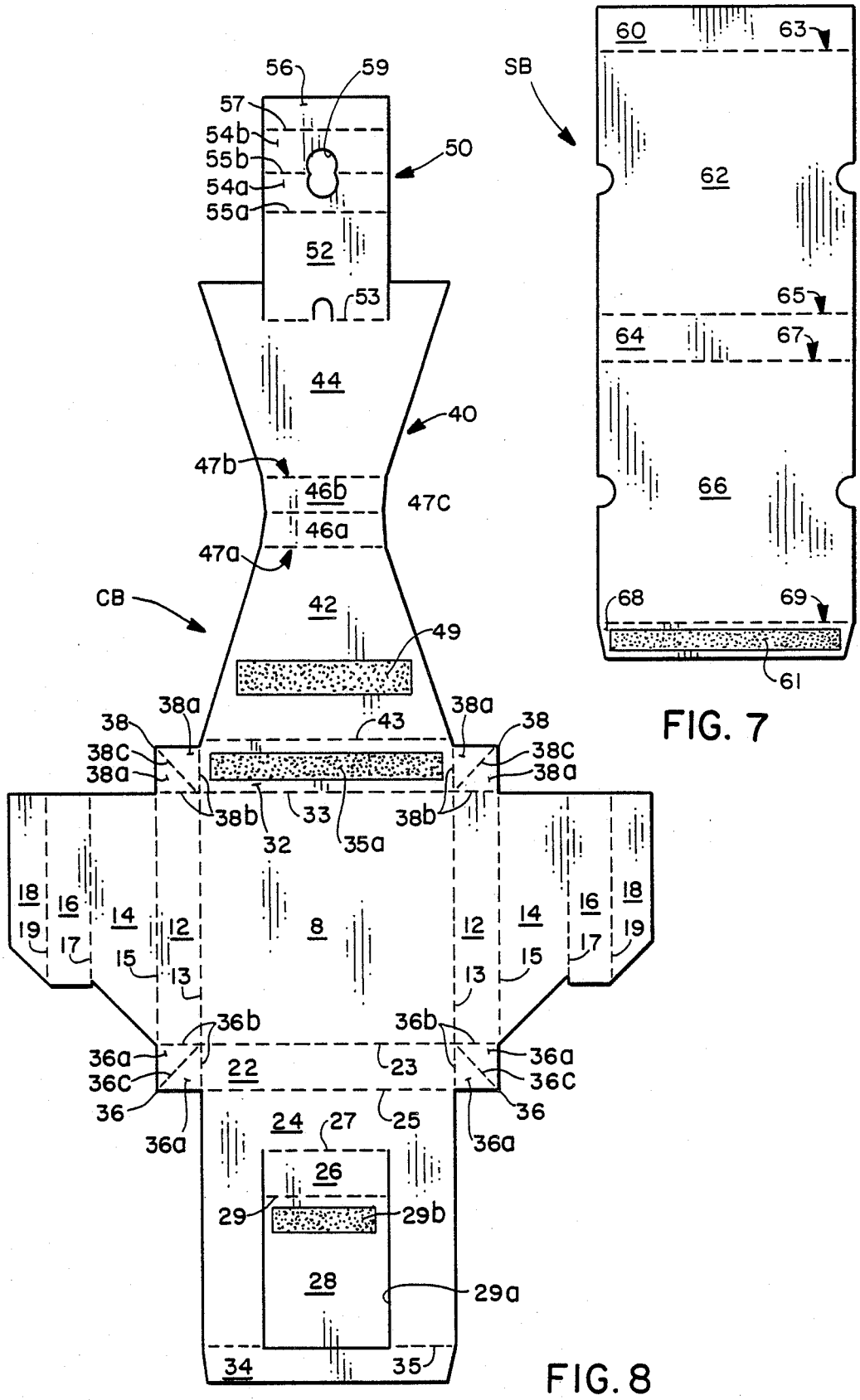
FIG. 7 is a plan view of a blank of foldable sheet material from which the outer sleeve illustrated in the other views may be formed.
FIG. 8 is a plan view of a blank of sheet material from which the carton illustrated in the other views may be formed.

The outer sleeve OS may be made from a unitary blank SB of foldable sheet material, such as paperboard, illustrated in FIG. 7 of the drawings, and the inner carton IC may be formed from the unitary blank CB of foldable sheet material illustrated in FIG. 8 of the drawings.

Figure 1:
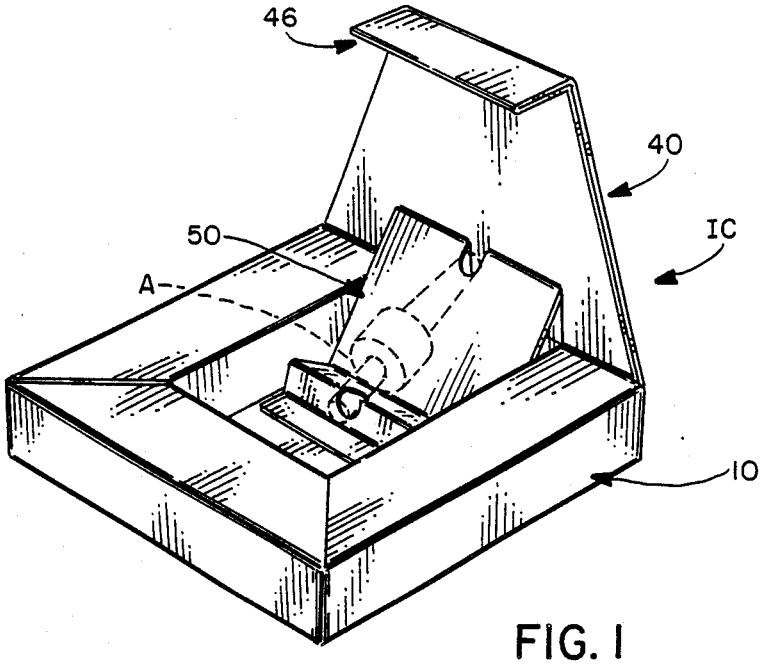
FIG. 1 is an isometric view of a carton for use in a package embodying features of the invention, with the carton shown in the open position.

Turning now to FIGS. 1 and 8 of the drawings, it will be seen that carton IC includes a preferably generally rectangular bottom wall panel 8 having a pair of hollow side walls 10, a hollow front end wall 20, and a flat rear end wall 30 joined thereto and extending upwardly therefrom to form a body with an opening or well 31 adapted to receive an article A, such as a spark plug, that is positioned within an article holding member 50 attached to and movable with the carton cover 40.

As best seen in FIG. 8, each of the side walls 10 is hollow and includes an outer panel 12, an upper panel 14, an inner panel 16, and an anchor panel 18, which are foldably joined to each other and to the side edges of bottom wall panel 8 along fold lines 13, 15, 17, and 19, respectively.

Front end wall 20 is also hollow and includes an outer panel 22, foldably joined on fold line 23 to a front edge of bottom wall panel 8, and a generally U-shaped upper panel 24, foldably joined along fold line 25 to the upper edge of front end wall outer panel 22, and extending rearwardly with its side portions underlying the respective adjacent side wall upper panels 14.

Front end wall 20 also includes an inner panel 26, foldably joined to upper panel 24 along fold line 27, and an anchor panel 28, foldably joined to the lower edge of inner panel 26 along fold line 29. Inner panel 26 and anchor panel 28 are both formed from material cut from upper panel 24 and are defined on three sides by a cut line 29*a*. When the carton is assembled, the anchor panel may be attached to the upper surface of bottom wall panel 8 by an adhesive indicated at 29*b*.

Rear wall 30 of the carton includes an outer panel 32, foldably joined along fold line 33 to the rear edge of bottom wall panel 8, and an inner or glue panel 34, foldably joined along fold line 35 to the rear edge of front end wall top panel 24. Inner panel 34 is folded downwardly from top panel 24 and is adhesively secured to the inner surface of inner panel 32 by an adhesive indicated generally 35*a*.

At the front and rear corners of the carton, the side walls are connected to the front and rear end walls by front and rear corner gussets 36 and 38, respectively. Gussets 36 each include a pair of generally triangular gusset sections 36*a* which are foldably joined along fold lines 36*b* to the related side and front end wall panels and which are foldably joined to each other along a diagonal fold line 36*c*.

Likewise, rear gussets 38 include gusset sections 38*a* which are foldably joined along fold line 38*b* to adjacent side and rear end wall panels and which are foldably joined to each other along a diagonal fold line 38*c*.

As seen in FIG. 8, the cover 40 of the carton includes an outer panel 42, foldably joined along fold line 43 to the upper edge of rear wall panel 32, and an inner panel 44, foldably connected to the outer panel 42 by a pair of tuck flap panels 46*a* and 46*b* which are foldably joined to the inner and outer panels 42 and 44 along parallel fold lines 47*a* and 47*b*, respectively, and which are foldably joined to each other along fold line 47*c*.

When the carton is formed, panels 42 and 44 are disposed in overlapped relation and secured to each other by an adhesive indicated at 49. The tuck flap panels 46*a* and 46*b* are folded in face-to-face relation with each other for insertion into the carton behind the front end wall when the cover is closed.

Still referring to FIG. 8, it will be seen than an article holding member, indicated generally at 50, is formed partially from material cut from cover inner panel 44 and is hingedly connected thereto.

The article holding member 50 includes a connecting panel 52, foldably joined to cover inner panel 44 on fold line 53, a first article holding or support panel 54*a*, foldably joined to connecting panel 52 on fold line 55*a*, a second support panel 54*b* foldably joined to the first support panel along a fold line 55*b*, and an anchor panel 56, foldably joined to second support panel along fold line 57. Support panels 54*a* and 54*b* are provided with adjacent openings which form a common opening 59 adapted to receive portions of a packaged article.

To erect the carton, the front end wall is formed first by folding outer panel 22 upwardly from bottom wall panel 8, folding upper panel 24 inwardly, and then folding the glue or rear end wall inner panel 34 downwardly and attaching it to the inner surface of the rear wall panel 32, as previously described. Also anchor panel 28 is folded forwardly from the inner panel along fold line 29 and secured to the upper surface of the bottom wall panel 8 by means of adhesive indicated at 29*b*.

To form the side walls, the side wall outer, upper, and inner panels are folded upwardly, rearwardly, and downwardly, respectively, with the upper panels 14 overlying side portions of the front end wall upper panel 24.

Figure 5:
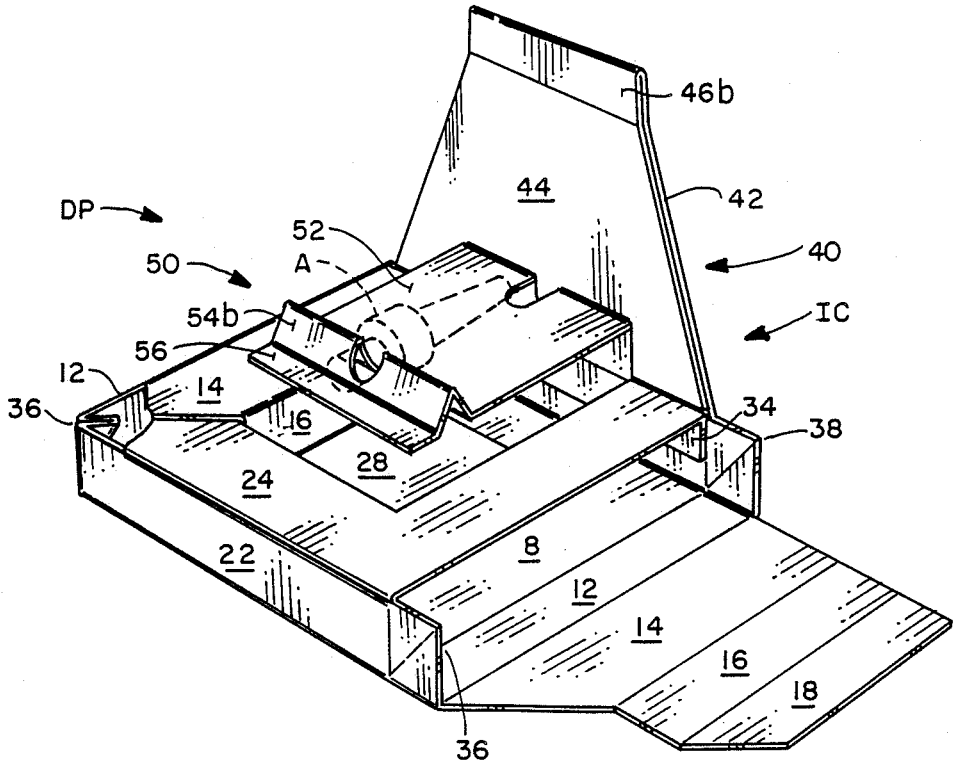
FIG 5. is a view similar to FIG. 1, but showing the carton prior to its being completely assembled, and with a portion of the structure broken away.
Figure 6:
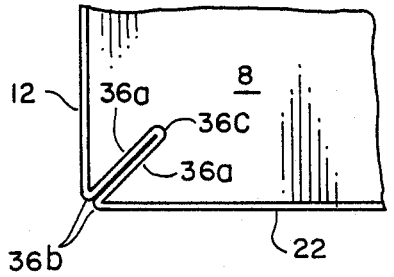
FIG. 6 is a fragmentary plan view of a portion of the corner structure of the carton illustrated in FIG. 5.

To form the cover 40 of the carton, the cover outer and inner panels 42 and 44, respectively, are folded in face-to-face relation with and secured to each other by adhesive indicated at 49, and the article retaining member 50 is folded to the position indicated in FIGS. 1 and 5 for support of the packaged article in opening 59. After the article has been placed within the inner carton, if an outer sleeve is to be used, the inner carton can then be placed within the outer sleeve.

As best seen in FIG. 7, the outer sleeve OS includes a first minor panel 60, a first major panel 62, a second minor panel 64, a second major panel 66, and a glue flap 68, which are foldably joined to each other along parallel fold lines 63, 65, 67, and 69, respectively, with the glue flap being secured to the first minor panel 60 by an adhesive indicated at 61.

Thus, it will be seen that the invention provides a unique package for displaying an article, whereby when the cover of the carton is opened, the article will pop up to be dramatically displayed.

What is claimed is:

1. A blank of foldable sheet material for use in forming a carton for holding and displaying an article, said blank being cut and scored to provide:

(a) a generally rectangular bottom wall panel having opposed front and rear end edges and opposed side edges;

(b) side wall outer panels foldably joined to respective side edges of said bottom wall panel;

(c) side wall upper panels foldably joined to outboard edges of respective side wall outer panels;

(d) side wall inner panels foldably joined to outboard edges of respective side wall upper panels;

(e) front and rear end wall outer panels foldably joined to respective front and rear end edges of said bottom wall panel;

(f) a front end wall upper panel foldably joined to an outboard edge of said front end wall outer panel;

(g) a rear wall inner panel foldably joined to an outboard edge of said front end wall upper panel;

(h) a front end wall inner panel cut from material of said front end wall upper panel and foldably joined to an edge thereof;

(i) a cover foldably joined to an outboard edge of said rear end wall panel and including at least one cover panel;

(j) an article holding member at least partly formed from material cut from said cover and foldably joined to an edge of the cover that is spaced inboardly from the outboard extremity of the cover.

2. A blank according to claim 1, and including an anchor panel foldably joined to an outboard edge of said front end wall inner panel and wherein said front end wall inner panel and anchor panel are surrounded on three sides by said front end wall upper panel.

3. A blank according to claim 1, wherein said cover comprises:

(a) an outer panel foldably joined to an outboard edge of said rear end wall panel;

(b) a tuck flap panel section foldably joined to an outboard edge of said outer panel;

(c) an inner panel foldably joined to an outboard edge of said panel section;

(d) an article holding member section foldably joined to an outboard edge of said inner panel.

4. A blank according to claim 3, wherein said article holding member section comprises:

(a) a connecting panel foldably joined to an edge of said cover inner panel;

(b) a first article holding panel foldably joined to an outboard edge of said connecting panel;

(c) a second article holding panel foldably joined to an outboard edge of said first article holding panel;

(d) said first and second article holding panels having article receiving openings extending therethrough.

5. A carton for holding and displaying an article, said carton being formed from a unitary blank of foldable sheet material such as paperboard and comprising:

(a) a generally rectangular, flat, bottom wall;

(b) a pair of front and rear end walls and a pair of side walls foldably joined to each other and to said bottom wall and upstanding from said bottom wall to form a carton body;

(c) said front end wall and said side walls being hollow and defining with said rear end wall and said bottom wall an article receiving well;

(d) a cover having a rear edge foldably joined to an upper edge of said rear end wall and disposed to extend forwardly therefrom;

(e) an article holding member hingedly attached to said cover and adapted to:

(i) extend downwardly and forwardly from an inside surface thereof for receipt within said body well when said cover is in a closed position;

(ii) move rearwardly and upwardly when said cover is moved from a closed to an open position;

(f) said front end wall comprising:

(i) an outer panel foldably joined to a front edge of said bottom wall;

(ii) an upper panel foldably joined to an upper edge of said outer panel and extending rearwardly therefrom;

(iii) an inner panel foldably joined to an inboard edge of said upper panel and extending downwardly therefrom;

(iv) an anchor panel foldably joined to a lower edge of said inner panel and extending rearwardly therefrom in engagement with an upper surface of said bottom wall.

6. A carton according to claim 5, wherein said front end wall upper panel is generally U-shaped and extends to said rear end wall.

7. A carton according to claim 5, and including a panel extending downwardly from rear edge of said front end wall upper panel and secured to an inner face of said rear end wall.

8. A carton for holding and displaying an article, said carton being formed from a unitary blank of foldable sheet material such as paperboard and comprising:

(a) a generally rectangular, flat, bottom wall;

(b) a pair of front and rear end walls and a pair of side walls foldably joined to each other and to said bottom wall and upstanding from said bottom wall to form a carton body;

(c) said front end wall and said side walls defining with said rear end wall and said bottom wall an article receiving well;

(d) a cover having a rear edge foldably joined to an upper edge of said rear end wall and disposed to extend forwardly therefrom;

(e) an article holding member hingedly attached to said cover and adapted to:

(i) extend downwardly and forwardly from an inside surface thereof for receipt within said body well when said cover is in a closed position;

(ii) move rearwardly and upwardly when said cover is moved from a closed to an open position;

(f) said front end wall comprising:

(i) an outer panel foldably joined to a front edge of said bottom wall;

(ii) an upper panel foldably joined to an upper edge of said outer panel and extending rearwardly therefrom;

(iii) an inner panel foldably joined to an inboard edge of said upper panel and extending downwardly therefrom;

(iv) an anchor panel foldably joined to a lower edge of said inner panel and extending rearwardly therefrom in engagement with an upper surface of said bottom wall.

9. A carton according to claim 8, wherein said front end wall upper panel is generally U-shaped and extends to said rear end wall.

10. A carton according to claim 8, and including a panel extending downwardly from a rear edge of said front end wall upper panel and secured to an inner face of said rear end wall.

11. A carton for holding and displaying an article, said carton being formed from a unitary blank of foldable sheet material such as paperboard and comprising:

(a) a generally rectangular, flat, bottom wall;

(b) a pair of front and rear end walls and a pair of side walls foldably joined to each other and to said bottom wall and upstanding from said bottom wall to form a carton body;

(c) said front end wall and said side walls being hollow and defining with said rear end wall and said bottom wall an article receiving well;

(d) a cover having a rear edge foldably joined to an upper edge of said rear end wall and disposed to extend forwardly therefrom;

(e) an article holding member hingedly attached to said cover and adapted to:

(i) extend downwardly and forwardly from an inside surface thereof for receipt within said body well when said cover is in a closed position;

(ii) move rearwardly and upwardly when said cover is moved from a closed to an open position;

(f) said front end wall including an outer panel extending upwardly from said bottom wall and an upper panel extending rearwardly from said outer panel, and wherein said rear end wall includes an outer panel foldably upstanding from said bottom wall and an inner panel extending downwardly from said front end wall upper panel and secured to an inner face of said rear end wall outer panel.

12. A carton for holding and displaying an article, said carton being formed from a unitary blank of foldable sheet material such as paperboard and comprising:

(a) a generally rectangular, flat, bottom wall;

(b) a pair of front and rear end walls and a pair of side walls foldably joined to each other and to said bottom wall and upstanding from said bottom wall to form a carton body;

(c) said front end wall and said side walls defining with said rear end wall and said bottom wall an article receiving well;

(d) a cover having a rear edge foldably joined to an upper edge of said rear end wall and disposed to extend forwardly therefrom;

(e) an article holding member hingedly attached to said cover and adapted to:

(i) extend downwardly and forwardly from an inside surface thereof for receipt within said body well when said cover is in a closed position;

(ii) move rearwardly and upwardly when said cover is moved from a closed to an open position;

(f) said front end wall including an outer panel extending upwardly from said bottom wall and an upper panel extending rearwardly from said outer panel, and wherein said rear end wall includes an outer panel upstanding from said bottom wall and an inner panel extending downwardly from said front end wall upper panel and secured to an inner face of said rear end wall outer panel.

13. A carton for holding and displaying an article, said carton being formed from a unitary blank of foldable sheet material such as paperboard and comprising:
(a) a generally rectangular, flat, bottom wall;
(b) a pair of front and rear end walls and a pair of side walls foldably joined to each other and to said bottom wall and upstanding from said bottom wall to form a carton body;
(c) said front end wall and said side walls being hollow and defining with said rear end wall and said bottom wall an article receiving well;
(d) a cover having a rear edge foldably joined to an upper edge of said rear end wall and disposed to extend forwardly therefrom;
(e) an article holding member hingedly attached to said cover and adapted to:
(i) extend downwardly and forwardly from an inside surface thereof for receipt within said body well when said cover is in a closed position;
(ii) move rearwardly and upwardly when said cover is moved from a closed to an open position;
(f) said cover comprising:
(i) an outer panel foldably joined to an upper edge of said rear wall;
(ii) an inner panel secured to an underside of said outer panel;
(iii) an article holding member foldably joined to said inner panel;
(iv) a pair of tuck flap panels disposed in face-to-face relation and foldably joined to respective cover outer and inner panels.

14. A carton for holding and displaying an article, said carton being formed from a unitary blank of foldable sheet material such as paperboard and comprising:
(a) a generally rectangular, flat, bottom wall;
(b) a pair of front and rear end walls and a pair of side walls foldably joined to each other and to said bottom wall and upstanding from said bottom wall to form a carton body;
(c) said front end wall and said side walls defining with said rear end wall and said bottom wall an article receiving well;
(d) a cover having a rear edge foldably joined to an upper edge of said rear end wall and disposed to extend forwardly therefrom;
(e) an article holding member hingedly attached to said cover and adapted to:
(i) extend downwardly and forwardly from an inside surface thereof for receipt within said body well when said cover is in a closed position;
(ii) move rearwardly and upwardly when said cover is moved from a closed to an open position;
(f) said cover comprising:
(i) an outer panel foldably joined to an upper edge of said rear wall;
(ii) an inner panel secured to an underside of said outer panel;
(iii) an article holding member foldably joined to said inner panel;
(iv) a pair of tuck flap panels disposed in face-to-face relation and foldably joined to respective cover outer and inner panels.

15. A carton for holding and displaying an article, said carton being formed from a unitary blank of foldable sheet material such as paperboard and comprising:
(a) a generally rectangular, flat, bottom wall;
(b) a pair of front and rear end walls and a pair of side walls foldably joined to each other and to said bottom wall and upstanding from said bottom wall to form a carton body;
(c) said front end wall and said side walls being hollow and defining with said rear end wall and said bottom wall an article receiving well;
(d) a cover having a rear edge foldably joined to an upper edge of said rear end wall and disposed to extend forwardly therefrom;
(e) an article holding member hingedly attached to said cover and adapted to:
(i) extend downwardly and forwardly from an inside surface thereof for receipt within said body well when said cover is in a closed position;
(ii) move rearwardly and upwardly when said cover is moved from a closed to an open position;
(f) said cover comprising:
(i) an outer panel foldably joined to an upper edge of said rear wall;
(ii) an inner panel secured to an underside of said outer panel;
(iii) an article holding member foldably joined to said inner panel;
(g) said article holding member comprising:
(i) a connecting panel foldably joined to said cover inner panel;
(ii) a first article holding panel foldably joined to said connecting panel;
(iii) a second article holding panel foldably joined to said first article holding panel;
(iv) an anchor panel foldably joined to said second article holding panel.

16. A carton for holding and displaying an article, said carton being formed from a unitary blank of foldable sheet material such as paperboard and comprising:
(a) a generally rectangular, flat, bottom wall;
(b) a pair of front and rear end walls and a pair of side walls foldably joined to each other and to said bottom wall and upstanding from said bottom wall to form a carton body;
(c) said front end wall and said side walls defining with said rear end wall and said bottom wall an article receiving well;
(d) a cover having a rear edge foldably joined to an upper edge of said rear end wall and disposed to extend forwardly therefrom;
(e) an article holding member hingedly attached to said cover and adapted to:
(i) extend downwardly and forwardly from an inside surface thereof for receipt within said body well when said cover is in a closed position;
(ii) move rearwardly and upwardly when said cover is moved from a closed to an open position;
(f) said cover comprising:
(i) an outer panel foldably joined to an upper edge of said rear wall;
(ii) an inner panel secured to an underside of said outer panel;
(iii) an article holding member foldably joined to said inner panel;
(g) said article holding member comprising:

(i) a connecting panel foldably joined to said cover inner panel;

(ii) a first article holding panel foldably joined to said connecting panel;

(iii) a second article holding panel foldably joined to said first article holding panel;

(iv) an anchor panel foldably joined to said second article holding panel.

* * * * *